US006496663B2

(12) United States Patent
Shimizu et al.

(10) Patent No.: US 6,496,663 B2
(45) Date of Patent: Dec. 17, 2002

(54) IMAGE FORMING APPARATUS INCLUDING IMAGE BEARING MEMBER AND ELECTRIFICATION MEANS WITH CHANGEABLE PERIPHERAL SPEED DIFFERENCE THEREBETWEEN

(75) Inventors: Yasushi Shimizu, Toride; Junichi Kato, Kashiwa; Hiroshi Sato, Moriya-machi; Masahiro Yoshida, Kashiwa; Hiroyuki Ohba, Toride, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/788,461

(22) Filed: Feb. 21, 2001

(65) Prior Publication Data

US 2001/0031149 A1 Oct. 18, 2001

(30) Foreign Application Priority Data

Feb. 24, 2000 (JP) ..... 2000-047780

(51) Int. Cl.[7] ..... G03G 15/02
(52) U.S. Cl. ..... 399/50; 399/176
(58) Field of Search ..... 399/50, 174, 175, 399/176

(56) References Cited

U.S. PATENT DOCUMENTS 5,164,779 A * 11/1992 Araya et al.
5,678,129 A * 10/1997 Yasuda et al. ..... 399/50
5,678,136 A * 10/1997 Watanabe et al. ..... 399/176 X
5,809,379 A 9/1998 Yano et al. ..... 399/159
5,933,681 A * 8/1999 Suzuki ..... 399/50
6,088,548 A * 7/2000 Hashimoto et al. ..... 399/50
6,118,952 A * 9/2000 Furuya ..... 399/50

FOREIGN PATENT DOCUMENTS

JP 6-3921 1/1994

* cited by examiner

*Primary Examiner*—Fred L. Braun
(74) *Attorney, Agent, or Firm*—Fitzpatrick, Cella, Harper & Scinto

(57) ABSTRACT

An image forming apparatus includes an image bearing member and an electrostatic image forming unit including an electrification device, which is disposed in contact with the image bearing member at an electrification location for performing injection electrification of the image bearing member. The apparatus is configured to change a peripheral speed difference between the electrification device and the image bearing member in accordance with a first period when an area of said image bearing member, which is to be an image forming area, is present in the electrification position; and a second period in which at least a particle of an area of said image bearing member, the area being a no-image area is present in the electrification position. The peripheral speed in the second period is smaller than the peripheral speed in the first period.

9 Claims, 10 Drawing Sheets

IMAGE FORMING APPARATUS INCLUDING IMAGE BEARING MEMBER AND ELECTRIFICATION MEANS WITH CHANGEABLE PERIPHERAL SPEED DIFFERENCE THEREBETWEEN

BACKGROUND OF THE INVENTION

1. Field of the Invention

The present invention relates an image forming apparatus such as an electrophotographic apparatus, an electrographic recording apparatus or the like having an electrification device for charging an image bearing member such as a photosensitive member or a dielectric member.

2. Related Background Art

An image forming apparatus such as an electrophotographic apparatus conventionally requires an electrification step of uniformly electrifying an image bearing member for forming an electrostatic latent image on the image bearing member and used as electrifying means is a corona electrification device or the like which is not brought into contact with the image bearing member. However, the corona electrification device poses problems in that it produces a large amount of ozone, and that is requires applying a high voltage on the order of 10 kV between the electrification device and the image bearing member.

As an electrification device which solves these problems, there has recently been proposed and put to practical use the so-called contact electrification device which electrifies an image bearing member uniformly by applying a voltage to an electrifying member which is in direct contact with the image bearing member.

A) Roller Charging Device

A representative of the above described contact electrification device is a roller electrification device 2-X shown in FIG. 9.

An electrification member 2-X-*a* of the roller electrification device is a roller (electrification roller) having a layer of medium resistance disposed on an electrically conductive base roller which is kept in contact with an image bearing member 1 under a predetermined pressure, rotatably held by a bearing and rotated in a direction indicated by an arrow b while following a rotation of the image bearing member 1 which is rotatingly driven in a direction indicated by an arrow a. A predetermined bias voltage is applied from a power supply S1 between the above described roller 2-X-*a* and the image bearing member 1, whereby the above described image bearing member 1 is uniformly electrified at a uniform potential.

Applied as the above described voltage is (1) only a DC voltage or (2) a DC voltage overlapped with an AC voltage. In case of (1), a voltage on the order of −1300 V must be applied to obtain a potential of −600V on the image bearing member 1 or in case of (2), a potential on the image bearing member 1 can be set similarly at −600 V by applying a DC voltage of −600 V overlapped with an AC voltage not lower than 1500 Vpp.

In either case of (1) or (2), an electrification mechanism is governed by Paschen's law and the image bearing member 1 is electrified owing to a discharge phenomenon which takes place in an area such as an area H shown in FIG. 9 where Paschen's law is satisfied at a specific distance between the above described electrification roller 2-X-*a* and the image bearing member 1.

As understood from the electrification mechanism described above, however, such a contact electrification device causes discharge which is the same as that caused by the initially described corona electrification device in the minute spatial area H and also produces ozone though in an amount remarkably smaller than that produced by the corona electrification device. This ozone produces nitric oxide which has low resistance and a defective image is formed due to improper electrification when the nitric acid adheres to the image bearing member 1.

B) Injection Electrification Device

Japanese Patent Application Laid-Open No. 6-3921 or the like proposes an injection electrification process which is free from a problem of ozone production and therefore permits lowering a voltage to be applied to an electrification device.

This electrification process is characterized by being capable of setting a surface potential of an image bearing member nearly at a voltage applied to an electrification device without using a discharge phenomenon but by injecting electric charges to the image bearing member through direct electric charge transfer from the electrification device to a surface of the image bearing member which is brought into contact with the electrification device.

(1) Magnetic Brush Electrification Device

Several types of injection electrification devices are proposed as electrification device for realizing the above described injection electrification process.

As a representative one of the injection electrification devices, a magnetic brush type electrification device 2-Y is shown in FIG. 10. This electrification device is configured by a magnet 2-Y-*a*, a nonmagnetic electrification sleeve 2-Y-*b* which comprises the magnet 2-Y-*a*, a magnet carrier (magnetic carrier, magnetic powder) 2-Y-*c*, electrically conductive regulating blade 2-Y-*d*, a housing 2-Y-*e* and the like. The magnet carrier 2-Y-*c* is a substance which is magnetic and electrically conductive.

The electrification sleeve 2-Y-*b* is rotatably disposed in the housing 2-Y-*e* and a portion of a circumferential surface of the electrification sleeve 2-Y-*b* is exposed outside through an opening of the housing. The electrification device 2-Y is disposed in a condition where the portion of the electrification sleeve 2-Y-*b* exposed outside is opposed to the image bearing member 1 with a predetermined slight gap reserved. The magnet 2-Y-*a* is fixed so as not to rotate. The magnet carrier 2-Y-*c* is reserved in the housing 2-Y-*e*. The regulating blade 2-Y-*d* is disposed in the opening of the housing 2-Y-*e* so as to reserve a predetermined gap from the electrification sleeve 2-Y-*b*.

The magnet carrier 2-Y-*c* in the housing 2-Y-*e* is magnetically adsorbed and held as a magnetic brush to the circumferential surface of the electrification sleeve 2-Y-*b* by a magnetic field of the magnet 2-Y-*a*, conveyed as the electrification sleeve 2-Y-*b* rotates, regulated to a predetermined layer thickness by the regulating blade 2-Y-*d*, conveyed outside through the opening of the housing 2-Y-*e*, brought into contact with a surface of the image bearing member 1, frictionally slides on the surface of the image bearing member, and is returned and conveyed into the housing 2-Y-*e* as the electrification sleeve 2-Y-*b* rotates successively.

The image bearing member 1 is rotatingly driven in a direction indicated by an arrow a and the electrification sleeve 2-Y-*b* is rotatingly driven in a direction indicated by an arrow s reverse to a rotating direction of the image bearing member 1 in a contact portion (electrification portion) between the image bearing member 1 and the magnetic brush of the magnet carrier 2-y-*c*. In other words, the magnetic brush of the magnet carrier 2-Y-*c* rotates at a peripheral speed different from that of the image bearing member 1 as the electrification sleeve 2-Y-*b* rotates, thereby frictionally slides on the surface of the image bearing member 1.

In the magnetic brush electrification device 2-Y taken as this example, a DC voltage, for example, of −600 V is applied as an electrification bias voltage from a power supply S1 to the regulating blade 2-Y-*d*. Accordingly, a portion of the image bearing member 1 which is in contact with the magnetic brush of the magnet carrier 2-Y-*c* tends to be at the same potential. The image bearing member 1 is electrified at this time when electric charges are injected from the magnet carrier 2-Y-*c* to the image bearing member 1 beyond an energy barrier or electrification does not take place when electric charges move again from the image bearing member 1 to the magnet carrier 2-Y-*c* at a step the magnet carrier 2-Y-*c* separates from the image bearing member 1. This phenomenon is largely dependent on a surface energy barrier and electric charge holding capability of the image bearing member 1, whereas a frequency of occasions of contact between the magnet carrier 2-Y-*c* and the image bearing member 1 is important when the phenomenon is considered as a competitive reaction.

In order to enhance this contact frequency, it is effective to enhance a density of the magnetic brush by reducing a particle diameter of the magnet carrier 2-Y-*c* and strengthening a magnetic force of the magnet 2-Y-*a*, and enhance a rotating speed of the magnetic brush of the magnet carrier 2-Y-*c* relative to that of the image bearing member by setting the rotating direction s of the electrification sleeve 2-Y-*b* reverse to the advancing direction a of the image bearing member 1 in the electrification portion, thereby bringing the magnet carrier 2-Y-*c* into contact with the image bearing member 1 more times per unit time.

When the magnet carrier 2-Y-*c* which is a site to inject electric charges to the image bearing member 1 is brought into contact with the image bearing member 1 with a high frequency as described above, the surface potential of the image bearing member 1 is set at a potential nearly equal to −600 V which is applied to the regulating blade 2-Y-*d*, thereby permitting uniform electrification free from ununiform electrification even in a microscopic area.

(2) Fur Brush Electrification Device

Furthermore, an injection electrification device 2-Z which uses a fur brush roller 2-Z-*a* as an electrification member as shown in FIG. 11 is contrived an injection electrification device of a type different from the above described magnetic brush type.

In the fur brush type injection electrification device, fur has a role of the magnetic brush of the magnet carrier 2-Y-*c* in the above described magnetic brush electrification device 2-Y.

The fur brush roller 2-Z-*a* has electrically conductive soft fur planted at a high density so that a tip of the fur is in contact with the surface of the image bearing member. The image bearing member is rotatingly driven in a direction indicated by an arrow a, whereas the fur brush roller 2-Z-*a* is rotatingly driven in a portion (electrification portion) in contact with the image bearing member 1 in a direction indicated by an arrow s reverse to a rotating direction of the image bearing body 1. In other words, the fur brush roller 2-Z-*a* rotates at a peripheral speed different from the of the image bearing member 1 and frictionally slides on the surface of the image bearing member 1.

A predetermined DC voltage is applied from a power supply S1 to the fur brush roller 2-Z-*a* as the electrification bias voltage, whereby the surface of the image bearing member 1 is electrified.

(3) Sponge Roller Electrification Device

Furthermore, an injection electrification device 2-A of a type which uses an electrification sponge roller 2-A-*a* as an electrification member as shown in FIG. 12 is contrived as a type different from the above described magnetic brush type or fur brush type.

In the injection electrification device 2-A, electrically conductive particles Z having relatively low resistance which is referred to as electrification accelerating particles adhere to porous portions (hole portions) of a surface of the electrification sponge roller 2-A-*a* which rotates in contact with the image bearing member 1, and the electrification accelerating particles Z correspond to the magnet carrier 2-Y-*c* of the above described magnetic brush type and constitute an injection site.

The image bearing member 1 is rotatingly driven in a direction indicated by an arrow a, whereas the electrification sponge roller 2-A-*a* is rotatingly driven in a portion (electrification portion) in contact with the image bearing member 1 in a direction indicated by an arrow s reverse to a rotating direction of the image bearing member 1. In other words, the electrification sponge roller 2-A-*a* rotates at a peripheral speed different from that of the image bearing member 1 and frictionally slides on the surface of the image bearing member 1. In this case, the electrification accelerating particles Z are interposed between the electrification sponge roller 2-A-*a* and the image bearing member 1. A predetermined DC current is applied to the electrification sponge roller 2-A-*a* as an electrification bias voltage from a power supply S1, whereby the surface of the image bearing member 1 is electrified.

In any case of the magnetic brush electrification device 2-Y (FIG. 9), the fur brush electrification device 2-Z (FIG. 10) and the sponge roller electrification device 2-A (FIG. 11), however, a number of contacts between the injection site and the image bearing member 1 is important for the above described injection electrification device to maintain an electrification capability, and it is necessary for efficiently increasing the number of contacts to enhance a relative speed by rotating the electrification member in the direction c reverse to the rotating direction a of the image bearing member and enhance a contact pressure of the electrification member so as to increase a contact area between the image bearing member 1 and the electrification member. Accordingly, friction between the image bearing member 1 and the electrification member is enhanced, thereby posing a problem of service lives of both the member which are shortened by deterioration caused due to abrasion.

In the sponge roller type injection electrification device 2-A in particular, a contact pressure is high between the image bearing member 1 and the sponge roller 2-A-*a* used as the electrification member, the electrification accelerating particles Z having relatively high hardness are interposed between these members and functions like an abrasive, thereby posing a problem that the image bearing member 1 is badly damaged and a surface layer of the image bearing member 1 is cut off rather remarkably.

Means effective for reducing a cut amount of the image bearing member 1 in the image forming apparatus which uses the roller electrification device 2-X (FIG. 9) utilizing discharge are exemplified as follows:

(a) lowering a pressure of a cleaning member which is in contact with the image bearing member 1

(b) lowering an AC voltage to a minimum required level in a case where a DC voltage overlapped with an AC voltage is to be applied to the electrification roller 2-X-*a*

(c) shortening a time to apply a voltage between the image bearing member 1 and the electrification roller 2-X-*a*

However, it is known that the injection electrification devices described here do not always have means (a) or (b), scarcely damage the image bearing member 1 in (c) by applying voltages and cut the surface of the image bearing member 1 only by a physical force generated simply by friction.

Accordingly, the sponge roller 2-A-*a* used as the electrification member always slides on the image bearing member 1 while the image bearing member 1 is rotating in the image forming apparatus which uses the sponge roller type injection electrification device 2-A. In other words, this image forming apparatus allows the image bearing member 1 to be cut even at a pre-rotation process, a postrotation process, a sheet interval process and the like where the conventional example is capable of preventing the cutting of the electrification bias, thereby posing the problem that the service life of the image bearing member 1 is shortened.

Though it is conceivable to thicken the image bearing member 1 for prolonging the service life of the image bearing member 1, a thicker film degrades reproducibility of a latent image and blurs an image, thereby posing a problem that prolonged service life of the image bearing member is hardly compatible with a good image quality.

In case of this example, cutting of the image bearing member 1 is largely different, or three or more times as remarkable in not a few cases between operation modes of the image forming apparatus for successive sheet passage and independent sheet passage at processes including the prerotation process and the postrotation process.

It is therefore necessary to assume a maximum cut amount for determining a required thickness of the image bearing member, but there is posed not only a problem that such a thickness imposes too strict specifications and a waste cost on a user who operates an image forming apparatus frequently in the successive paper passage mode but also a problem that such a thickness obliges an image to be more or less lowered in a quality due to the above described degradation of the latent image.

In case of a cleanerless system which does not use a cleaner for cleaning the image bearing member and must have a electrification capability high enough to prevent the sponge roller 2-A-*a* from being influenced by a developer adhering in a small amount to the roller, there is posed a problem that the above described sponge roller 2-A-*a* must have a higher contact pressure and cuts the image bearing member in a larger amount.

SUMMARY OF THE INVENTION

An object of the present invention is to provide an image forming apparatus which is capable of reducing abrasion of an image bearing member and electrification means.

Another object of the present invention is to provide an image forming apparatus which uses electrification means for injection electrification and is capable of maintaining a high image quality for a long time.

DETAILED DESCRIPTION OF THE PREFERRED EMBODIMENTS

<First Embodiment> (FIGS. 1 through 5)

Figure 1:
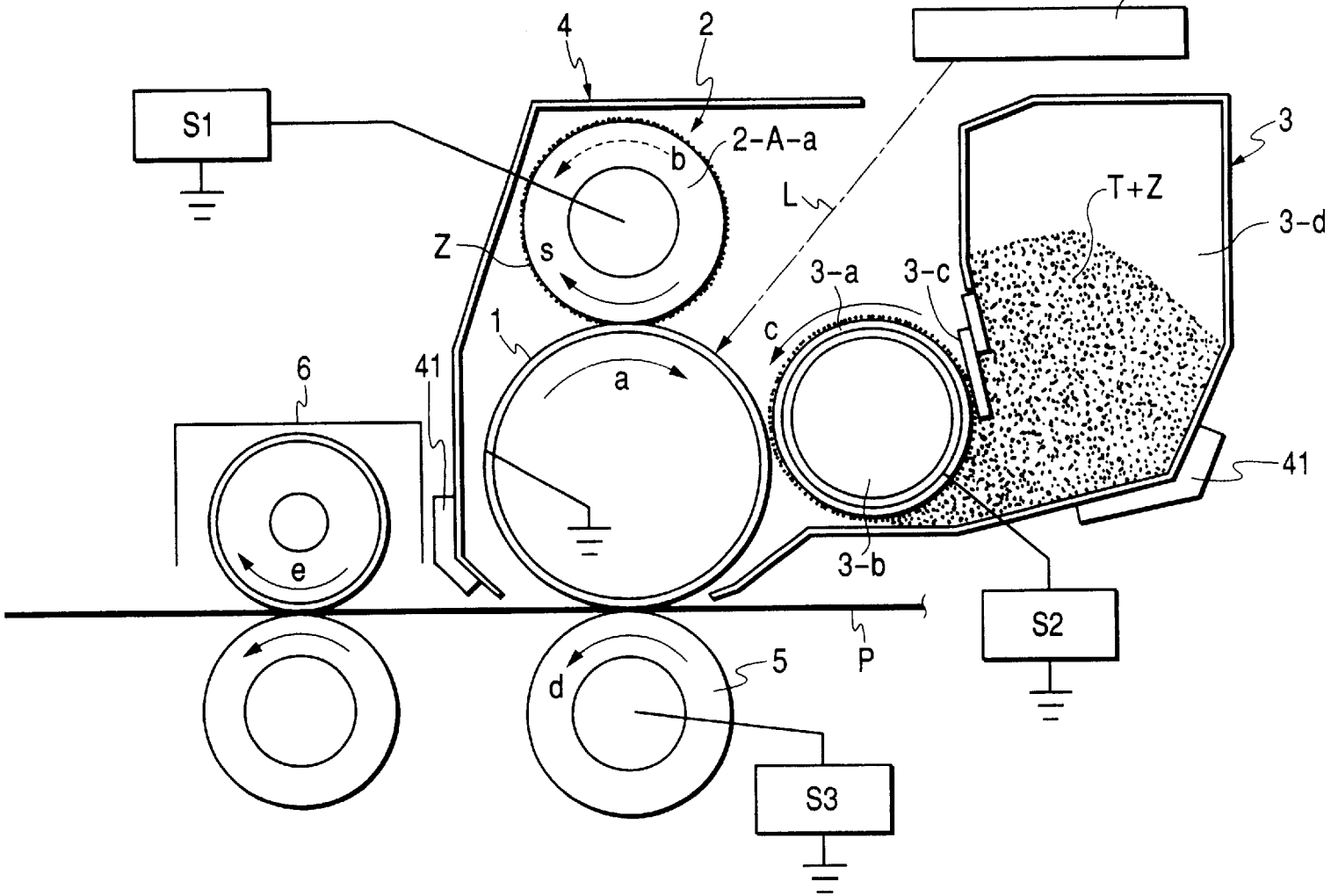
FIG. 1 is a schematic configurational diagram of an image forming apparatus according to a first embodiment.

FIG. 1 is a schematic diagram of an image forming apparatus according to the present invention. The image forming apparatus according to the first embodiment is a reversal developing, cleanerless, process cartridge type laser beam printer which utilizes a transferring electrophotography process and an injection electrification method using electrification accelerating particles.

(1) Overall Configuration of Printer

Reference numeral 1 denotes a rotating drum type electrophotographic photosensitive member (hereinafter referred to as a photosensitive drum) which functions as an image bearing member. This member is, for example, an OPC photosensitive drum having a negative polarity and rotatingly driven at a predetermined peripheral speed (process speed) in a direction indicated by an arrow a.

Figure 9:
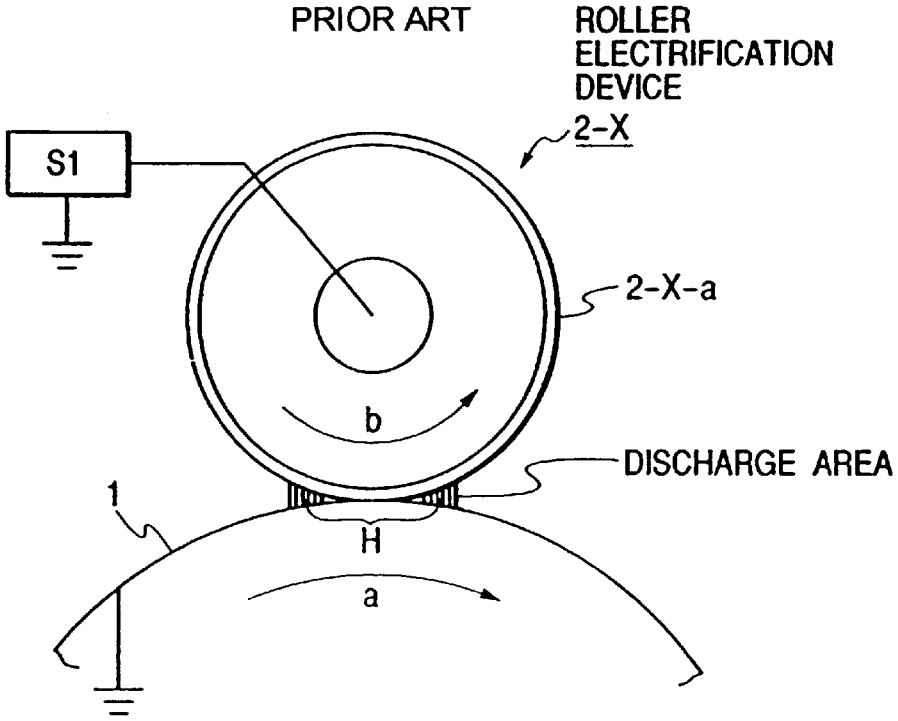
FIG. 9 PRIOR ART
FIG. 9 is a diagram of a roller electrification device.
Figure 10:
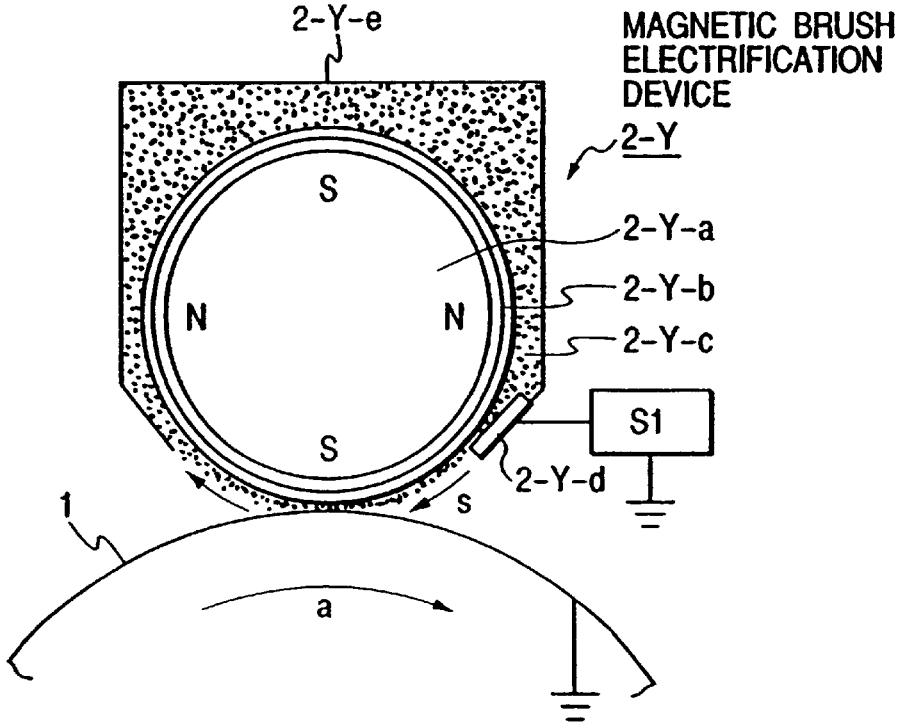
FIG. 10 PRIOR ART
FIG. 10 is a diagram of a magnetic brush electrification device.
Figure 11:
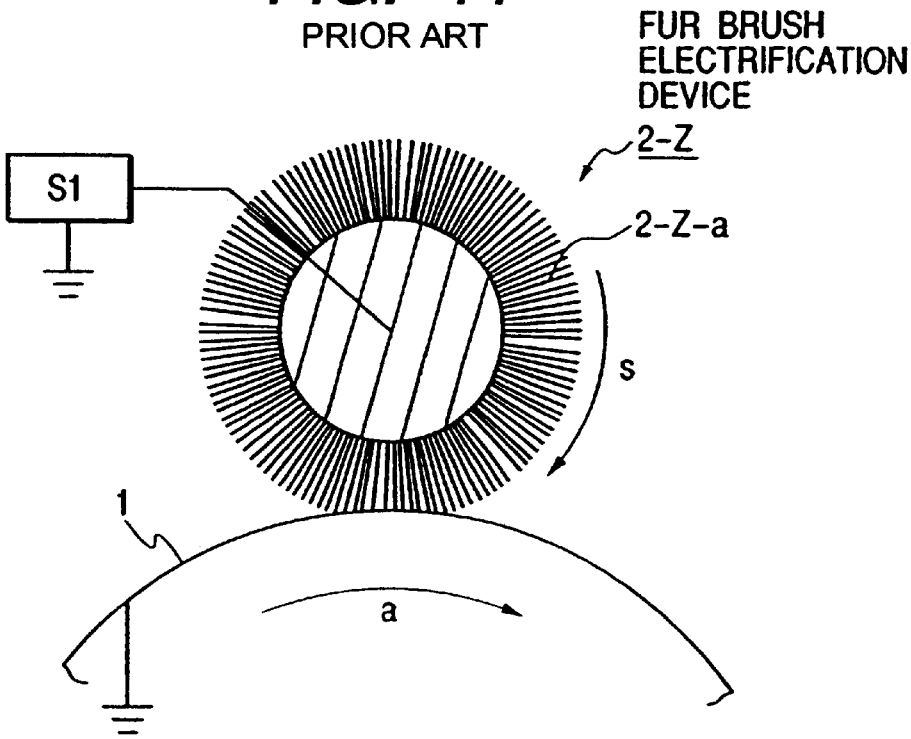
FIG. 11 PRIOR ART
FIG. 11 is a diagram of a fur brush electrification device.
Figure 12:
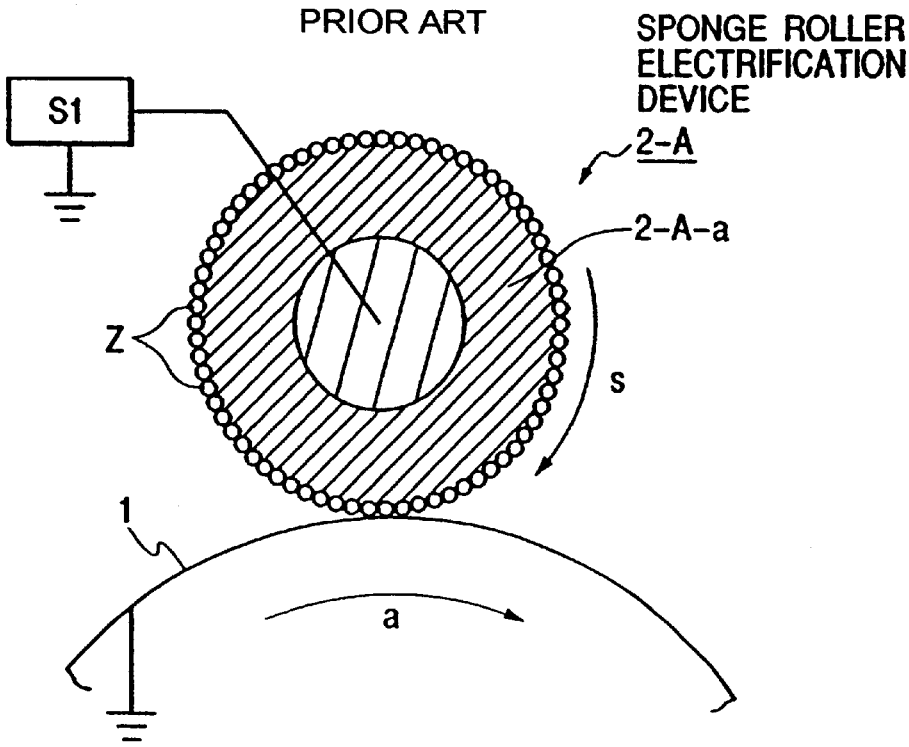
FIG. 12 PRIOR ART
FIG. 12 is a diagram of a sponge roller electrification device.

Reference numeral 2 denotes an electrification device which injects charges to electrify a surface of the photosensitive drum 1 uniformly to a predetermined polarity and a predetermined potential. In the first embodiment, this device is a sponge roller electrification device similar to the above described sponge roller electrification device shown in FIG. 9 and the surface of the photosensitive drum 1 is subjected to a uniform injection electrification treatment to −600 V (a dark portion potential Vd) with an electrification sponge roller 2-A-*a* which is covered with electrification accelerating particles Z as a contact electrification member. The electrification device 2 will be described in detail later.

Reference numeral 7 denotes a laser beam scanner functioning as information write means. This scanner 7 comprises a laser diode, a polygonal mirror and the like and outputs a laser beam L which is modulated in intensity in correspondence to time series digital pixel signals of object image information input from a host apparatus such as a computer (not shown), thereby scanning and exposing the uniformly electrified surface of the rotating photosensitive drum 1. This scanning exposure lowers a potential at the portion of the photosensitive drum surface which is irradiated with the laser beam and produces a potential difference between portions of the photosensitive drum surface which are exposed and not exposed, thereby forming an electrostatic latent image corresponding to an exposure pattern. In the first embodiment, the so-called light portion potential V1 at the portion of the photosensitive drum which is exposed is −150 V in contrast to the so-called dark portion potential Vd of −600 V at the portion of the photosensitive drum surface which is not exposed.

Reference numeral 3 denotes a developing apparatus. In the first embodiment, the developing apparatus is a reversal developing apparatus using the so-called jumping developing method which does not bring a developing member into contact with the photosensitive drum 1 and develops the electrostatic latent image in reversal by adhering a negative toner as a developer to the portion of the light portion potential of the photosensitive drum surface. This developing apparatus 3 will be described in detail later in section (4).

Reference numeral 5 denotes a transferring roller having medium resistance functioning as contact transferring means which is pressed to the photosensitive drum 1 under a predetermined pressure to form a transferring nip portion and rotating at a peripheral speed nearly the same as that of the photosensitive drum 1 in a direction indicated by an arrow d which is forward in a rotating direction a of the photosensitive drum 1. A transferring material (transferring sheet) P is fed as a recording medium to the transferring nip portion from a sheet feed portion (not shown) at a predetermined timing and a predetermined transferring bias voltage, for example, of +2 kV having a polarity reverse to that of an electrification polarity of the toner is applied from a power supply S3 to the transferring roller 5, whereby a toner image is electrostatically transferred from the surface of the photosensitive drum 1 to a surface of the transferring material P consecutively in the transferring nip portion.

Reference numeral 6 denotes a fixing apparatus which is of a heat fixing type or the like. The transferring material P which is fed to the transferring nip portion and to which the toner image is transferred is separated from the surface of the rotating photosensitive drum 1, introduced into the fixing apparatus 6, subjected to fixing treatment of the toner image and discharged outside the image forming apparatus as an article on which an image is formed (print, copy).

In the first embodiment, the printer is a cleanerless type which has no cleaner exclusively for cleaning the photosensitive drum and the toner remaining on the surface of the photosensitive drum 1 after transferring the toner image to the transferring material P in the transferring nip portion is not removed with an exclusive cleaner (cleaning device) but reaches the developing portion by way of the electrification device 2 as the photosensitive drum 1 successively rotates, recovered and used once again by cleaning simultaneous with developing in the developing apparatus 3. This cleanerless system will be described in detail later in section (5).

In the first embodiment, the printer is configured as a process cartridge 4 detachable from a printer main body by integrating three process appliances of the photosensitive drum 1, the electrification sponge roller 2-A-*a* and the developing apparatus 3. Reference numerals 41 and 41 denote cartridge guide holding members.

A process cartridge is a member which is configured by integrating at least one of electrification means, developing means and cleaning means with a electrophotographic photosensitive member (image bearing member) so that the member is attachable and detachable to and from a main body of an image forming apparatus.

(2) Operation Sequence of Printer

Figure 2:
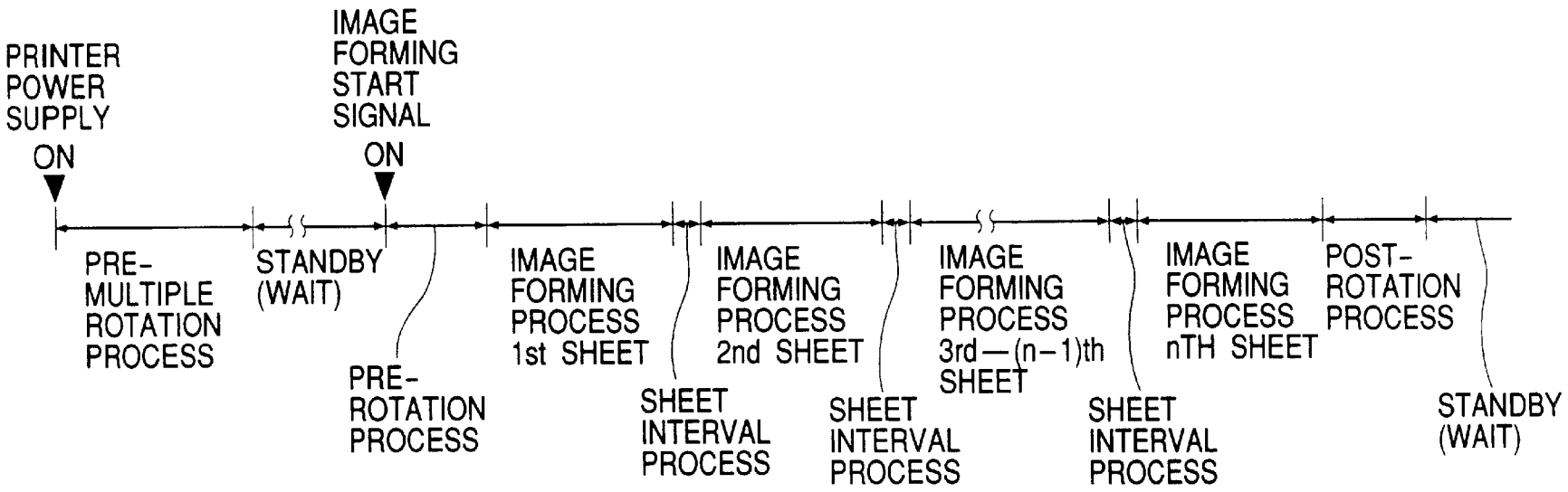
FIG. 2 is a operation sequence diagram of an image forming apparatus.

FIG. 2 is a diagram showing an operation sequence of the above described printer.

a. Premultiple Rotation Process (Initial Rotation Process)

This process is a start operation period (start operation period, warming period) at a start time of the printer. When a power switch is turned on, the printer rotatingly drives the photosensitive drum, heats the fixing apparatus to a predetermined temperature and performs other predetermined preparatory operations for the process appliances.

b. Prerotation Process (Print Preparatory Rotating Operation)

This process is a preparatory rotating operation period before image formation from a time when an image forming start signal (print signal) is turned on until an image forming (print) process operation is actually performed and executed successively to the premultiple rotation process when the image forming start signal is input during the premultiple rotation process. When the image forming start signal is not input, driving of a main motor is once intercepted after completing the premultiple rotation process, whereby rotating driving of the photosensitive drum is stopped and the printer is set in a standby state until the print signal is input. The prerotation process is executed when the image forming start signal is input.

c. Image Forming Process (Print Process, Image Formation Process)

Upon completion of the predetermined prerotation process, an image forming process is successively executed for the rotating photosensitive drum, whereby the toner image formed on the surface of the rotating photosensitive drum is transferred to the transferring material and fixed by the fixing apparatus, and an article on which an image is formed is printed out.

In a successive image forming (successive copy, successive print) mode, the above described image forming process is executed repeatedly in a set print number n.

d. Sheet Interval Process

This process is a period where the transferring material does not pass through the transferring portion (no-image forming area between image forming areas) after a tailing end of the transferring material has passed through the transferring portion until a leading end of a next transferring material reaches the transferring portion in the successive image forming mode.

e. Postrotation Process

This process is a period where the photosensitive drum is rotatingly driven by driving the main motor continuously for some while even after the image forming process for a final transferring material is completed, thereby executing predetermined post operations.

f. Standby

After completing a predetermined postrotation process, the driving of the main motor is stopped, whereby the rotating driving of the photosensitive drum is stopped and the printer is set in the standby state until a next image forming start is input.

In case of print on a single sheet, the printer is set in the standby state by way of the postrotation process after completing the print.

When the image forming start signal is input in the standby state, the printer proceeds to the prerotation process.

(3) Electrification Device 2

In the first embodiment, the electrification device 2 is a sponge roller electrification device which is an injection electrification device. The electrification sponge roller 2-A-*a* functioning as the contact electrification member is an electrically conductive roller which has hardness of 30 degrees and an average pore diameter of 50 82 m and an outer circumferential surface covered with the electrification accelerating particles Z, and is in contact with the photosensitive drum 1 under a predetermined pressure and rotatingly driven by a driving system (not shown) in a electrification nip portion in contact with the photosensitive drum 1 in a direction indicated by an arrow s which is a reverse direction (counter direction) to the rotating direction of the photosensitive drum 1. The electrification means has the electrification member and the electrification particles as described above. At an image forming time, a surface of the above described electrification sponge roller 2-A-*a* moves at a speed of 1.5 times as high as that of the surface of the photosensitive drum 1, or at a speed 250% relative to a speed of the surface of the photosensitive drum 1, while reserving a difference between peripheral speeds. A predetermined electrification bias voltage is applied to the electrification sponge roller 2-A-*a* from the power supply S1.

Used as the electrification accelerating particles Z are electrically conductive particles of zinc oxide which have an average particle diameter of 3 $\mu$m including secondary assemblies and a specific resistance of $10^6$ Ω·cm. The electrification accelerating particles have a positive polarity which is reverse to a negative polarity of a toner T used as a developer. The electrification accelerating particles Z adhere mainly to the portions on the outer circumferential surface of the electrification sponge roller 2-A-*a*, thereby covering the electrification sponge roller 2-A-*a*. Accordingly, the electrification accelerating particles Z are present in the electrification nip portion which is a contact portion between the electrification sponge roller 2-A-*a* and the photosensitive drum 1.

The electrification accelerating particles Z are electrically conductive particles used to aid electrification, allowed to be present in the electrification nip portion, thereby making it possible to reduce friction in the electrification nip portion between the electrification sponge roller 2-A-*a* and the photosensitive drum 1 with the wetting effect of the particles (friction reducing effect), lower a rotating torque of the electrification sponge roller 2-A-*a*, bring the electrification sponge roller 2-A-*a* into contact with the photosensitive drum 1 with the peripheral speed difference (speed difference) closely and uniformly by way of the electrification accelerating particles Z so that the electrification accelerating particles Z rubs the surface of the photosensitive drum a with no gap in the electrification nip portion and ozonelss direct injection electrification is governing at a low application voltage even when a simple member such as a roller is used as an electrification member. Furthermore, the electrification accelerating particles Z make it possible to electrify microscopic portions uniformly or without ununiformity.

The injection electrification system is an electrification system which is configured to electrify an image bearing member not by using a discharge phenomenon basically but by injecting electric charges to the image bearing member to be electrified directly from an electrification member and capable of electrifying the image bearing member to a potential nearly corresponding to an application voltage even when a voltage applied to the electrification member is a voltage not higher than a discharge threshold value with no adverse influence due to discharge products since ions are not produced due to the discharge phenomenon.

In the first embodiment, an electrification bias voltage of −610 V is applied from the power supply S1 to the electrification sponge roller 2-A-*a*. Accordingly, the photosensitive drum 1 and the electrification sponge roller 2-A-*a* tend to be the same potential at a portion where the electrification accelerating particles Z having the low resistance are in direct contact with the photosensitive drum 1 and the electrification sponge roller 2-A-*a* in an area where these members are in contact, whereby electric charges are induced to the surface of the photosensitive drum 1, which tends to be a potential of −610 V the same as that on a side of the electrification sponge roller 2-A-*a*.

When the electrification sponge roller 2-A-*a* is separated from the surface of the photosensitive drum 1 subsequently, the electric charges move once again so as to reduce electric charges on the photosensitive drum 1 and since a reduction amount of the electric charges is determined by resistance values of the electrification sponge roller 2-A-*a*, the electrification accelerating particles Z and the photosensitive drum 1 as well as a layer configuration of the photosensitive drum 1, the first embodiment is configured to obtain a system which minimizes the reduction amount and capable of obtaining a surface potential of −600 V on the photosensitive drum 1.

Usable as a material for the electrification accelerating particles Z is various kinds of electrically conductive particles of another metal oxide or mixture of organic substance in addition to zinc oxide. In order to obtain a uniform electrification property, particle diameter is not larger than 50 $\mu$m or preferably not larger than 10 $\mu$m. It is considered that a lower limit of the particle diameter lies at 10 nm for obtaining particles stably. Since electric charges are transferred by way of the particles, the particles have specific resistance preferably not higher than $10^{12}$ Ω·cm, more preferably not higher than $10^{10}$ Ω·cm. No problem is posed by the electrification accelerating particles Z which are present not only in a state of primary particles but also in a state of agglomerate secondary particles.

It is desired that the photosensitive drum 1 which is used as the image bearing member in this system has a high electric charge injecting efficiency and a strong electric charge holding force. Furthermore, it is demanded that the photosensitive drum 1 prevents the cutting due to abrasion as the object of the present invention. In the first embodiment, the photosensitive drum 1 has an overcoat layer 3 $\mu$m thick having low resistance and high hardness which is disposed over an electric charge moving layer formed as a surface layer of a general organic photosensitive member. Accordingly, the photosensitive drum 1 is capable of obtaining electrification performance higher than that of the general organic photosensitive member and reduces the cutting though the photosensitive drum 1 is manufactured on the basis of an inexpensive organic photosensitive member at a slightly higher cost.

Since a problem is posed in this system by a capability of the electrification sponge roller 2-A-*a* and the electrification accelerating particles Z to electrify the photosensitive drum 1, the first embodiment is configured to set a force to press the electrification sponge roller to the photosensitive drum so that the contact nip is 3 mm wide between the photosensitive drum 1 and the electrification sponge roller 2-A-*a*, and set the peripheral speed of the electrification sponge roller 2-A-*a* at 250% of the peripheral speed of the photosensitive drum 1 as described above in order to always obtain a required electrification capability. Owing to these settings, this system has electrifying performance which is always stable until the developer T is completely consumed in the developing apparatus in a usually conceivable environment.

(4) Developing Apparatus 3

In the first embodiment, the developing apparatus 3 is a reversal developing apparatus using the so-called jumping developing method which does not bring a developing member into contact with the photosensitive drum 1 and a negatively chargeable magnetic single-component negative toner as the developer T. A predetermined amount of the electrification accelerating particles Z are added and mixed to and with the developer T (hereinafter referred to as a toner) contained in the developer container so that the electrification accelerating particles Z are supplied (replenished) from the above described developing apparatus 3 to the electrification sponge roller 2-A-*a* of the above described electrification device 2 by way of the photosensitive drum 1.

Reference numeral 3-*a* denotes a developing sleeve made of a non-magnetic material, reference numeral 3-*b* denotes a developing magnet contained in the developing sleeve, reference numeral 3-*c* denotes a developing blade kept in contact with the developing sleeve and reference numeral 3-*d* denotes a developer container. The developing sleeve 3-*a* is disposed in opposition to the photosensitive drum 1 contactlessly with a gap 300 μm reserved between the photosensitive drum 1 and the developing sleeve 3-*a*. The developing portion is formed by portions of the developing sleeve 3-*a* and the photosensitive drum 1 which are opposed to each other. The developing sleeve 3-*a* is rotatingly driven at a predetermined peripheral speed in a direction indicated by an arrow c which is the forward direction of the rotating direction of the photosensitive drum 1. The developing magnet 3-*b* is a fixed member which does not rotate. Contained in the developer container 3-*d* is a mixture of the magnetic toner T used as the developer and the electrification accelerating particles Z. In the first embodiment, the electrification accelerating particles Z are added to and mixed with the toner T at a ratio of 2 parts by weight and move in a condition where most of the electrification accelerating particles Z adhere to the toner T when a strong electric force is not exerted.

The developing sleeve 3-*a* has a roughened surface, holds the magnetic toner T including the electrification accelerating particles Z on a surface and conveys the toner T in the direction indicated by the arrow c in cooperation with the magnetic force of the developing magnet 3-*b* contained. Conveyed toner T is regulated in its height (layer thickness regulation) on the developing sleeve 3-*a* and receives electric charges produced by friction while passing along a surface in contact with the developing blade 3-*c*. In the first embodiment, the toner T is mostly electrified negatively due to an electrification polarity of a material of the toner T. Simultaneously, the electrification accelerating particles Z are electrified positively which passing along this area.

After passing a position of the developing blade 3-*c*, the toner T and the electrification accelerating particles Z are conveyed to the developing portion by a successive rotation of the developing sleeve 3-*a*. A predetermined DC voltage overlapped with an AC voltage is applied from a power supply S2 to the developing sleeve 3-*a*, and the Toner T selectively fly and adhere from the developing sleeve 3-*a* to the surface of the photosensitive drum 1 in the developing portion in correspondence to an electrostatic latent image pattern, thereby developing the latent image in reversal. The electrification accelerating particles Z also move and adhere from the developing sleeve 3-1 to the surface of the photosensitive drum 1. The toner T and the electrification accelerating particles Z remaining on the developing sleeve 3-*a* are conveyed by a successive rotation of the developing sleeve 3-*a* for returning into a developer reservoir in the developer container 3-*d*.

Figure 3:
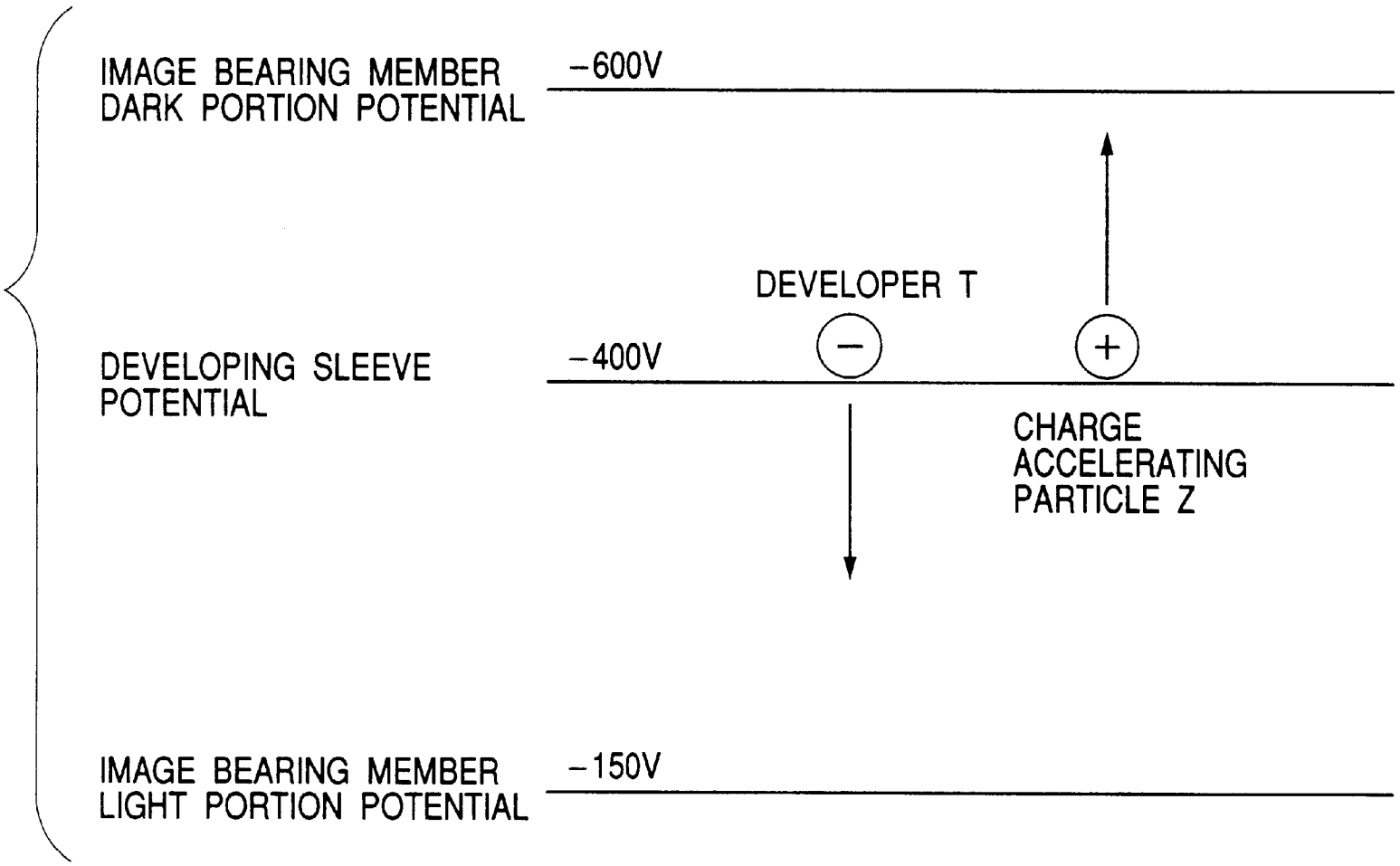
FIG. 3 is a diagram descriptive of behaviors of a developer (toner) and an electrification accelerating particle in a developing portion.

With reference to FIG. 3, description will be made here of behaviors of the electrified toner T and electrification accelerating particles Z in the developing portion between the developing sleeve 3-*a* and the photosensitive drum (image bearing member) 1.

When the above described negatively electrified toner T reaches an area close to the photosensitive drum 1, the toner T develops an electrostatic latent image owing to an electric field formed between the photosensitive drum a and the developing sleeve 3-*a*. In the first embodiment, a developing bias voltage of a DC voltage of −400 V overlapped with an AC voltage having a frequency of 1500 Hz and a rectangular waveform of 1600 Vpp is applied to the photosensitive drum 1 and the negatively electrified toner T flies not to a dark portion potential Vd=−600 V but to a light portion potential V1=−150 V in the gap of 300 μm formed between the photosensitive drum 1 and the developing sleeve 3-*a*.

Though the electrification accelerating particles Z which are positively electrified are liable to fly to a dark portion potential area at this time reversely to the above described toner T, the electrification accelerating particles mostly adhere to the toner T itself due to sizes of the particles and exhibit a moving behavior similar to that of the toner T without exhibiting a behavior reverse to that of the toner T when an electrostatic force relative to the toner T is stronger. Accordingly, the electrification accelerating particles Z can fly to both areas at both the light portion potential and the dark portion potential.

(5) Supply of electrification accelerating particles to cleanerless system and electrification sponge roller The toner T transferred to the photosensitive drum 1 at the developing is transferred to the transferring material P at a transferring process. As a transferring bias voltage, a DC voltage of 2 kV relative to the photosensitive drum 1 is applied from a power supply S3 to the transferring roller used as the transferring apparatus 5 and the toner T which is electrified negatively relative to the electric field formed between the photosensitive drum 1 and the transferring roller 5 is attracted toward the transferring roller 5, whereby most of the toner T is transferred to the transferring material P.

Speaking of the electrification accelerating particles Z which are positively electrified, on the other hand, most of the particles which adhere to the toner T transfer together with the toner T to the transferring material P on a light portion potential, but a larger amount of particles remain on the photosensitive drum 1 since the particles are electrically more stable on the photosensitive drum 1. Furthermore, most of the electrification accelerating particles Z which adhere to the dark portion potential area remain on the photosensitive drum 1.

Accordingly, a slight amount of the toner T which remain in the light portion potential area after the transferring process and the electrification accelerating particles Z which remain in a relatively large amount over the entire surface of the photosensitive drum 1 exist on the photosensitive drum 1 after the transferring process.

Since the printer according to the first embodiment is cleanerless, the toner T and the electrification accelerating particles Z which remain on the photosensitive drum 1 after the above described transferring process are carried by a successive rotation of the photosensitive drum 1 to the electrification nip between the electrification sponge roller 2-A-*a* of the electrification device 2 and the photosensitive drum 1.

Since the voltage of −610 V relative to the photosensitive drum 1 is applied to the electrification sponge roller 2-A-*a*, the positively electrified electrification accelerating particles Z tend to move to the electrification sponge roller 2-A-*a* from the surface of the photosensitive drum 1 which is electrified at a potential on a positive side at the transferring process as compared with the electrification sponge roller 2-A-*a*. The electrification accelerating particles Z are held on a minute surface of the sponge and serve for the electrification process as already described. That is, the electrification accelerating particles Z are supplied (replenished) from the developing apparatus 3 to the electrification sponge roller 2-A-*a* by way of the photosensitive drum 1.

On the other hand, most of the toner T which remains on the photosensitive drum 1 without being transferred is the so-called inverted component which is originally electrified positively and can hardly be transferred or electrified positively by the transferring voltage. This toner therefore also adheres to the electrification sponge roller 2-A-*a*, but since electric charges are imparted to the toner by frictional electrification and the like to set the toner at the regular negative electrification polarity while the toner passes several times through an area where the electrification process is performed by the photosensitive drum 1 and the sponge roller 2-A-*a*, the toner T which is originally liable to be electrified negatively is electrified negatively in a relatively short time, and most of the toner T returns again to the photosensitive drum 1 from the electrification sponge roller 2-A-*a*, carried to the developing portion by a successive rotation of the photosensitive drum 1 and assimilated by the toner T to be newly developed while passing through an area in the vicinity of the developing sleeve 3-*a* where the developing process is carried out, thereby being recovered into the developing apparatus 3 by the cleaning simultaneous with developing and used once again.

The cleaning simultaneous with developing is a method to recover a toner remaining on an image bearing member after transferring at a developing time at a next or subsequent process by successively electrifying the image bearing member, forming a latent image and with a fog eliminating bias (a fog eliminating potential difference Vback which is a potential difference between a DC voltage applied to a developing apparatus and a surface potential of the image bearing member) at a developing time of the latent image. This method allows the toner remaining after transferring to be recovered into the developing apparatus and used once again at the next or subsequent process, thereby making it possible to produce no waste toner and lessen a trouble for maintenance. Furthermore, the method makes it possible to configure a cleanerless image forming apparatus which is compact and has a merit from a viewpoint of an installation space.

(6) Measure for Reducing Cut Amount of Photosensitive Drum 1

Now, a description will be made of a measure to reduce a cut amount of the photosensitive drum 1 which is a problem posed on the present invention.

In the first embodiment, the electrification sponge roller 2-A-*a* is rotated at a relative peripheral speed 250% as high as that of the photosensitive drum 1 as described above, the photosensitive drum 1 and the electrification sponge roller 2-A-*a* are rotated essentially during a period of image formation on the photosensitive drum 1, that is, during a period of electrification of an area of the photosensitive drum 1 which is to be an image forming area, and a counter rotation of the above described electrification sponge roller 2-A-*a* is switched to a rotation driven by a rotation of the photosensitive drum 1 while the photosensitive drum 1 rotates in another period as shown by the arrow b in FIG. 1.

In the first embodiment, switching between the drive rotation and the driven rotation is performed with a clutch mechanism interposed in a driving system (not shown) for the above described roller. The clutch mechanism is on-off controlled at a predetermined control timing by a control circuit. On control connects a clutch to drive and rotate to drive and the electrification sponge roller. Off control disconnects the clutch to allow the electrification sponge roller to rotate freely or to be driven to rotate by the rotation of the photosensitive drum 1. That is, a peripheral speed difference between the sponge roller and the photosensitive drum 1 becomes nearly 0.

Figure 4:
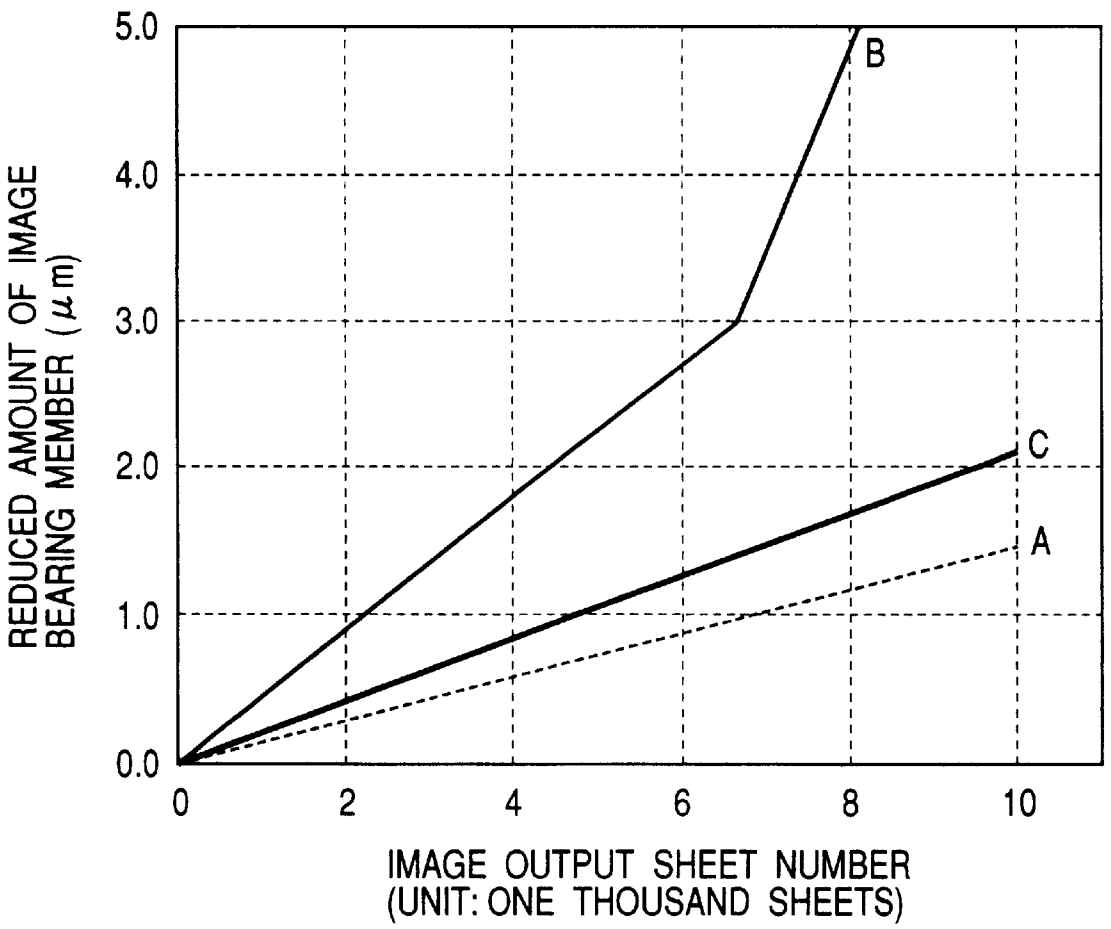
FIG. 4 is a graph showing correlations between an image output sheet number and a reduced amount of an image bearing member.

FIG. 4 shows amounts of the photosensitive drum 1 used as the image bearing member which are reduced for printing ten thousand sheets until the developer is consumed completely in the process cartridge 4 according to the first embodiment in a case where the present invention is applied and another case where the present invention is not applied.

Here, the image forming apparatus according to this embodiment takes 5 seconds per sheet to output a A4-sized sheet in the successive output mode, while it takes 15 seconds to output just one print.

In FIG. 4, reference character A denotes lines indicating reduced amounts of the photosensitive drum 1 when only the above described successive output mode is continued: inclinations of the lines A remaining unchanged between a case where the present invention is applied and the other case where the present invention is not applied.

On the other hand reference character B denotes a line indicating a reduced amount of the photosensitive drum 1 when only the single print output mode is repeated, the present invention is not applied and the electrification sponge roller 2-A-*a* is in the drive rotation condition while keeping a peripheral speed difference of 250% from a peripheral speed of the photosensitive drum 1 always during a rotation of the photosensitive drum 1: the line B indicating a reduced amount which is increased nearly in proportion to time as described above and about three times as large as that indicated by the lines A to a midpoint, which corresponds to 3 $\mu$m where the overcoat layer is cut completely, the reduced amount is abruptly increased and ten thousand sheet are not consumed completely.

When only the single print output mode is repeated and the present invention is applied, in contrast, a reduced amount is remarkably smaller than that indicated by the line B and has a value close to those of the lines A as indicated by a line C.

A description will be made below of a rotation control sequence of the electrification sponge roller 2-A-*a* in the first embodiment. When an electrification bias output and a developing bias output for outputting a print are denoted by Vc and Vdc respectively, these outputs are provided in an image forming period F in a sequence shown in FIG. 5. The above described developing bias output Vdc is basically nearly coincident with the above described image forming period F and the above described electrification bias Vc is output within a range which is slightly broader than the developing bias Vdc. A driving rotational movement of the electrification sponge roller 2-A-*a* according to the first embodiment is coincident with an output sequence of the above described electrification bias as indicated by Rc in FIG. 5. In another period indicated by Rf, the electrification sponge roller 2-A-*a* is driven rotated by the photosensitive drum 1. While the area of the photosensitive member which is to be the image forming area is at the electrification location (in the image forming period F), the roller 2-A-*a* is in a condition of the drive rotation. The image forming area is in a condition of the drive rotation. The image forming area is an area in which an image can be formed in correspondence to an optional image signal. While a portion of an area of the photosensitive member which is to be a no-image forming area is at the electrification location, the roller is in a condition of the driven rotation.

Though the drive rotation movement Rc of the above described electrification sponge roller 2-A-*a* is coincident with a rotational movement Rd of the photosensitive drum 1 in the conventional example where the present invention is not applied, the electrification sponge roller 2-A-*a* is in the drive-rotation condition only for seven seconds in the single print output mode and in the driven rotation condition for rest eight seconds in the first embodiment where the present invention is applied, whereby the photosensitive drum 1 is damaged remarkably little due to abrasion in this while and the cutting of the surface layer of the photosensitive drum 1 is suppressed to a value close to 7/5 times as high as that in the successive output mode.

In the driven rotation period Rf of the electrification sponge roller 2-A-*a* in this sequence, it is desirable to float the electrification sponge roller 2-A-*a* without applying the bias to the electrification sponge roller 2-A-*a* or set the electrification sponge roller 2-A-*a* at a potential on the order of the surface potential of the photosensitive drum 1.

This is because physical movements of particles are liable to occur between the electrification sponge roller 2-A-*a* and the photosensitive drum 1 in the driven rotation period Rf.

While the electrification sponge roller 2-A-*a* is driven rotated Rc in the direction reverse to the rotating direction of the photosensitive drum 1, the electrification sponge roller 2-A-*a* which has a rough surface exhibits a high effect to scratch off the developer T and the electrification accelerating particles Z and the particles are not moved so remarkably by an electric force produced by a potential difference between the surfaces.

In the condition of the driven rotation Rf, on the other hand, the above described scratching effect is lowered and the particles are liable to be moved by the electric force. When a potential difference is produced between the photosensitive drum 1 and the electrification sponge roller 2-A-*a*, the developer T and the electrification accelerating particles Z adhering to the electrification sponge roller 2-A-*a* are easily moved onto the photosensitive drum 1, whereby an electrification capability is apt to be insufficient when the electrification accelerating particles are moved in a large amount or a defective image is output when the toner is moved in a large amount and cannot be recovered into the developing apparatus 3 at the developing process.

It is basically sufficient that the electrification bias output is provided within the range slightly broader than the image forming period as already described, but the electrification bias output is required for a charge eliminating process or the like, it is necessary to perform the drive rotation of the electrification sponge roller 2-A-*a*, and the voltage application to the electrification sponge roller 2-A-*a* is not limited to the above described process when the particle movement is to be caused intentionally as a cleaning sequence of the electrification sponge roller 2-A-*a*.

Though the system using the electrification sponge roller 2-A-*a* and the electrification accelerating particles Z is taken as an example in the first embodiment, the present invention is applicable also to the magnetic brush system and the fur brush system described with reference to the conventional example where a relative speed of the electrification member is enhanced by rotating this member in a counter direction and the photosensitive drum 1 is remarkably deteriorated due to abrasion.

Though the electrification sponge roller 2-A-*a* is driven rotated in at least a partial period other than the image forming period in the first embodiment since a driven rotation mechanism has a simple configuration and the electrification sponge roller 2-A-*a* has a speed of 0 relative to the photosensitive drum 1, it is possible to reduce abrasion of the photosensitive drum 1 simply by slowing down a speed of the electrification member without driven rotating this member in a case where driven rotation of the electrification member is difficult as in a case of the above described magnetic brush system or the fur brush system.

The first embodiment makes it possible to minimize the reduced amount of the photosensitive drum 1, limit a film thickness of the photosensitive drum 1 so as to form a favorable image and lessen frictional load and deterioration due to abrasion of the electrification sponge roller 2-A-*a* used as the electrification member, thereby making it possible to stably obtain highly precise latent images for a long time, enhance a quality of images output from an image forming apparatus and prolong a service life of the image forming apparatus.

Figure 6:
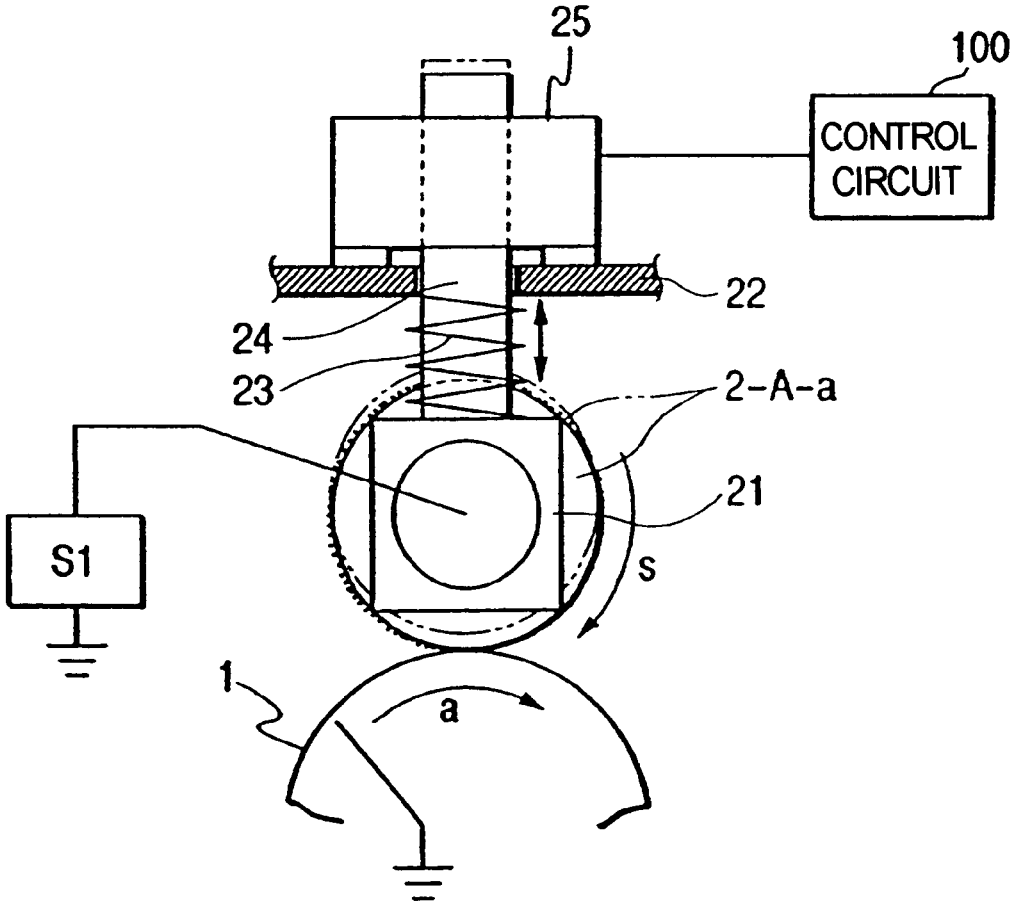
FIG. 6 is a diagram showing main members of an image forming apparatus according to a second embodiment.
Figure 7:
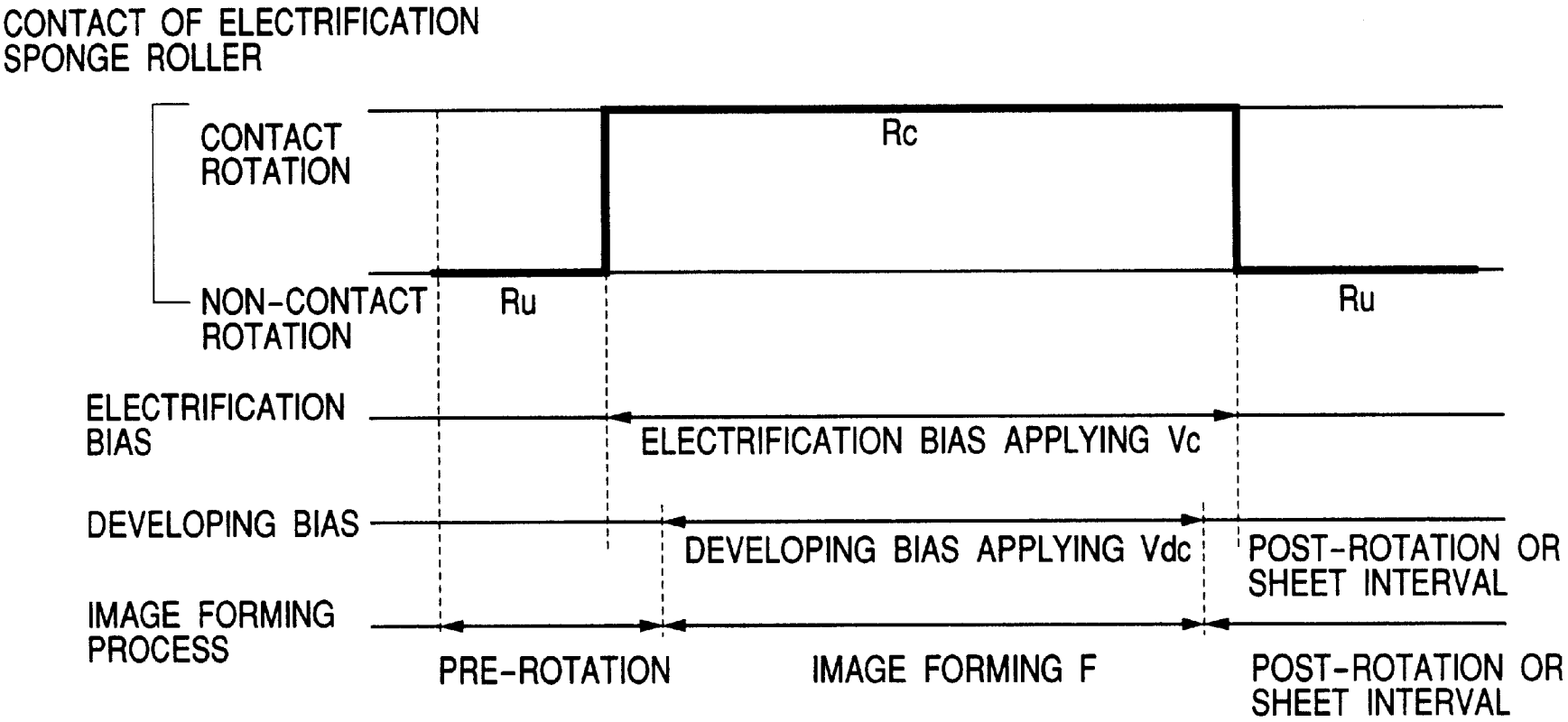
FIG. 7 is a control sequence diagram of the image forming apparatus according to the second embodiment.
Figure 8:
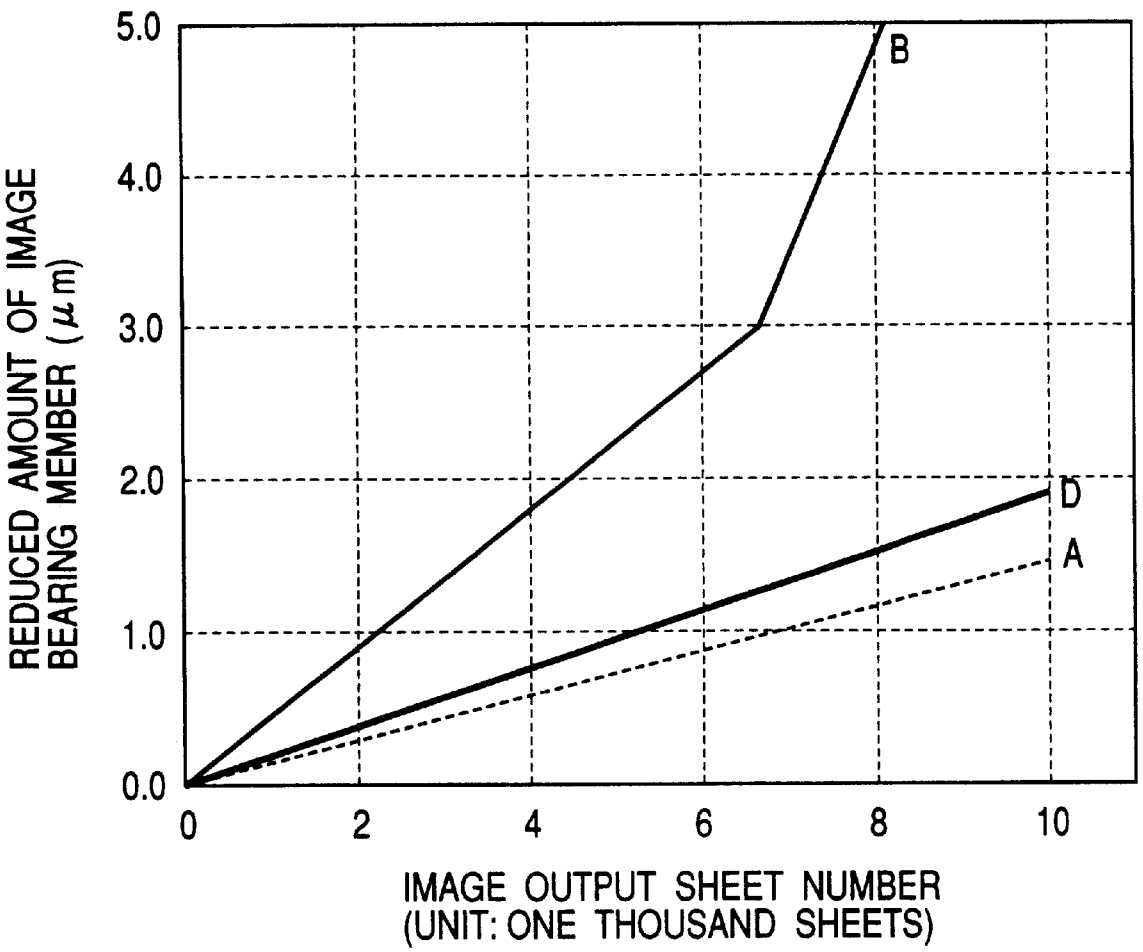
FIG. 8 is a graph showing correlations between an image output sheet number and a reduced amount of an image bearing member.

<Second Embodiment> (FIGS. 6 through 8)

In a second embodiment, the electrification sponge roller 2-A-*a* is kept in contact with the photosensitive drum 1 under a predetermined contact pressure essentially only while an image is being formed on the photosensitive drum 1 and is maintained in a condition where the electrification sponge roller 2-A-*a* is contactlessly apart from the photosensitive drum 1 in another period where the photosensitive drum 1 is rotating.

FIG. 6 exemplifies a mechanism for bringing the electrification sponge roller 2-A-*a* into contact with the photosensitive drum 1 and releasing the roller from the drum. Specifically, the electrification sponge roller 2-A-*a* is rotatably held at both ends of a center shaft with bearings 21 respectively. The bearings at both the ends are movable bearings which can freely move along guide members (not shown) in directions to come into contact and apart with and from the photosensitive drum 1. A press spring 23 is compressed between each bearing 21 and an immovable spring bracket member 22 and the electrification sponge roller 2-A-*a* is kept in contact with the photosensitive drum 1 under a predetermined contact pressure by a stretching force of the compressed press spring.

In correspondence to each bearing 21, an electromagnetic solenoid 24 is fixed to the immovable spring bracket 22 and an advance/retreat rod 25 for the electromagnetic solenoid 24 is integrally attached to the bearing 21.

When a power supply to the electromagnetic solenoid 24 is turned on, the bearing 21 is raised against the stretching force of the compressed press spring 23, and the electrification sponge roller 2-A-*a* is raised and kept in a condition where the roller is contactlessly apart.

When the power supply to the electromagnetic solenoid 24 is turned off in this condition, raising of the bearing 21 is stopped and the electrification sponge roller 2-A-*a* returns to a condition where the roller is kept in contact with the photosensitive drum 1 under the predetermined contact pressure.

A control circuit 100 performs on/off control of the power supply to the electromagnetic solenoid 24 at a predetermined control timing.

Even while the photosensitive drum 1 is driven, the electrification sponge roller 2-A-*a* can be moved so as to come in contact or apart with or from the photosensitive drum 1 by the on/off control of the power supply to the above described electromagnetic solenoid 24.

Figure 5:
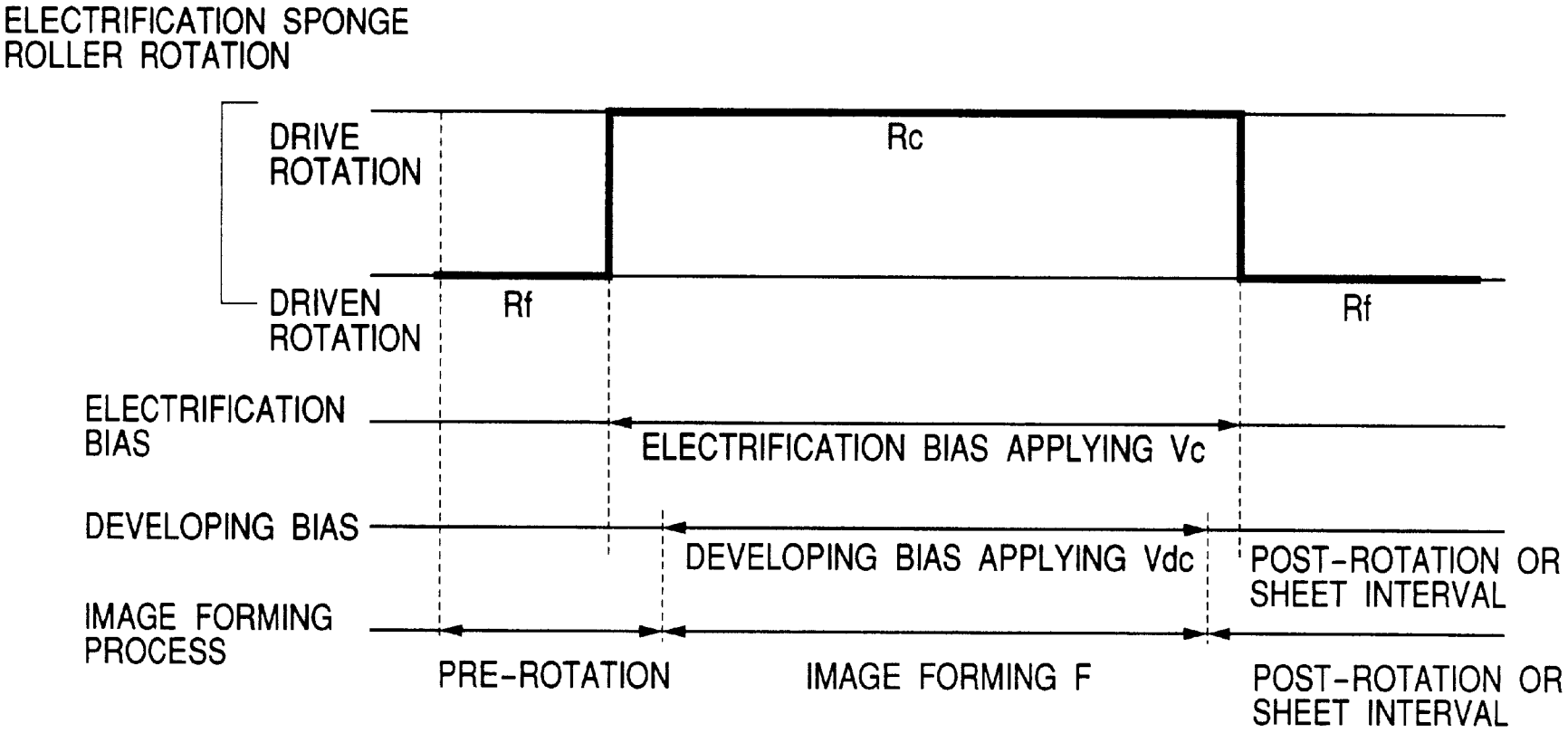
FIG. 5 is a control sequence diagram of the image forming apparatus according to the first embodiment.

The second embodiment is configured to set bias application, a drive rotation and the like in an image forming system similarly to those in the image forming area F on the photosensitive drum 1 shown in FIG. 5 operation sequence diagram, and set a condition where the electrification sponge roller 2-A-*a* is in contact with the photosensitive drum 1 as in the first embodiment as shown in FIG. 7.

In a period other than the image forming period F, on the other hand, the electrification sponge roller 2-A-*a* is made apart from the photosensitive drum 1 by turning on a power supply to the above described electromagnetic solenoid 24. A process to make the electrification sponge roller 2-A-*a* apart from the photosensitive drum 1 is shown as Ru in FIG. 7 sequence diagram and corresponds to the driven process Rf in the first embodiment.

Accordingly, the second embodiment provides a sufficient electrification function during image formation on the photosensitive drum 1 like the first embodiment but does not bring the electrification sponge roller 2-A-*a* into contact with the photosensitive drum 1 in a period other than the period where an image is formed on the photosensitive drum 1, thereby eliminating friction between the photosensitive drum 1 and the electrification sponge roller 2-A-*a* and making it possible to lessen the reduced amount of the photosensitive drum 1, load and deterioration of the electrification sponge roller 2-A-*a* due to friction, and prevent abrasion more effectively than the first embodiment.

In the above described sequence in the second embodiment, the electrification sponge roller 2-A-*a* is in the drive rotation condition while being in contact with the photosensitive drum 1 for seven seconds as in the first embodiment and a reduced amount of the photosensitive drum 1 in the second embodiment is closer to A indicating the reduced amount in the successive output mode than the reduced amount in the first embodiment as indicated by D in FIG. 8 in a case where the single output mode is repeated as described with reference to the first embodiment.

In the second embodiment, the electrification sponge roller 2-A-*a* is brought into contact and released with and from the photosensitive drum 1 simply by moving the electrification sponge roller 2-A-*a* itself, and a driving force may not be transmitted to the electrification sponge roller 2-A-*a* and this roller may be not be driven upon releasing the pressure.

In the second embodiment also, a pressure releasing process is performed basically according to the processes where the electrification bias is not applied, but as in the case of the first embodiment, it is not necessary to make all the processes coincide with them.

Like the first embodiment, the second embodiment is not limited to the injection electrification device using the electrification sponge roller 2-A-*a* and is applicable also to another injection electrification system such as the magnetic brush system, the fur brush system and the like.

Though the electrification sponge roller 2-A-*a* is made completely apart from the photosensitive drum 1 in the second embodiment, an effect to reduce abrasion of the photosensitive drum 1 can be obtained even by weakening a contact pressure and in the injection device which uses the above described magnetic brush system or fur brush system in particular, an effect similar to that obtained by making the electrification member apart from the photosensitive drum 1 can be obtained without making the electrification member completely apart from the photosensitive drum 1 so far as a contact pressure is nearly 0 between the electrification member and the photosensitive drum 1.

Accordingly, the second embodiment also makes is possible to minimize the reduced amount of the photosensitive drum 1, limit a film thickness of the photosensitive drum 1 so as to form a favorable image and lessen a load and deterioration due to friction as well as abrasion of the electrification sponge roller 2-A-*a* used as the electrification member, thereby making it possible to obtain highly precise latent images stably for a long time, enhance an quality of an image output from the image forming apparatus and prolong a service life of the image forming apparatus.

<Others>

1) The control sequence to reduce the peripheral speed difference and the contact pressure between the electrification member and the image bearing member can be executed at one, a combined plurality or all of the premultiple rotation process, the prerotation process, the sheet interval process and the postrotation process which are no-image forming processes other than the image forming process.

2) The image bearing member may be a direct injection electrification type which has a charge injecting layer having surface resistance of $10^9$ to $10^{14}$ Ω·cm. Even when the image bearing member has no charge injecting layer, a similar effect can be obtained so far as a charge transporting layer has resistance within the above described range. An amorphous silicon photosensitive member which uses a surface layer having volume resistance of approximately $10^{13}$ Ω·cm is preferably usable.

3) A flexible contact electrification member which has a shape and a material of felt or cloth is also usable. By combining various kinds of materials, it is possible to obtain an electrification member which has more preferable elasticity, electrical conductivity, surface properties and durability.

4) Sine wave, rectangular wave, triangular wave or the like are selectable as a waveform of an alternating voltage component of an oscillating electric field (an AC component, a voltage having a periodically varying value). A rectangular wave may be formed by periodically turning on and off a DC power supply.

5) Image exposure means as means for writing information on the electrified surface of the image bearing member may be, for example, a digital exposure means using a solid-state light emitting element array such as LEDs other than the laser scanning means used in the embodiment. The image exposure means may be an analog exposure means using a halogen lamp, fluorescent lamp or the like as a light source for illuminating an original. The image exposure means is sufficiently usable so far as the means can form an electrostatic latent image corresponding to image information.

6) The image bearing member may be an electrographic recording dielectric member. In this case, an electrostatic latent image corresponding to object image information is written and formed by uniformly electrifying a surface of the above described dielectric member and selectively eliminating charges from the electrified surface by charge eliminating means such as a charge eliminating needle head, an electron gun or the like.

7) A method and means for developing an electrostatic latent image are optional. The developing method may be a reversal developing method or a regular developing method.

Generally speaking, methods for developing an electrostatic latent image are classified roughly into a method (single-component contactless development) which develops an electrostatic latent image by coating a nonmagnetic toner over a developer carrying member such as a sleeve with a blade or the like or coating a magnetic toner over the developer carrying member with a magnetic force, carrying and applying the toner to an image bearing member in a contactless condition, a method (single-component contact development) which develops an electrostatic latent image by applying a toner which is coated over a developer carrying member as described above in a contact condition, a method (two-component contact development) which develops an electrostatic latent image using a magnetic carrier mixed with toner particles as a developer (two-component developer), carrying the developer with a magnetic force and applying the developer to an image bearing member in a contact condition, and a method (two-component contactless development) which develops an electrostatic latent image by applying the above described two-component developer to an image bearing member in a contactless condition.

8) The transferring means is not limited to the transferring roller in the embodiments and may be transferring blade, a transferring belt, another contact transferring electrification member or a contactless transferring electrification member using a corona charger.

9) The present invention is applicable not only to monochromatic image formation using an intermediate transferring member such as a transferring drum or a transferring belt but also to an image forming apparatus which forms a multicolor or fill color image by multiple transferring.

10) It is needless to say that the image forming apparatus may be of a type which comprises a cleaning device exclusively for eliminating a residual developer from the surface of the image bearing member after transferring.

11) The electrification sponge roller may not be brought into direct contact with the image bearing member when the image bearing member is to be electrified so far as the electrically conductive particles which are present between the electrification sponge roller and the image bearing member are in contact with the image bearing member.

What is claimed is:

1. An image forming apparatus comprising:

an image bearing member; and electrostatic image forming means for forming an electrostatic image on said image bearing member, wherein said electrostatic image forming means includes electrification means for electrifying said image bearing member, said electrification means being disposed in contact with said image bearing member at an electrification location and for performing injection electrification of said image bearing member, wherein a peripheral speed difference between said electrification means and said image bearing member is changed in accordance with a first period in which an area of said image bearing member, the area being an image forming area, is present in the electrification position, and a second period in which at least a portion of an area of said image bearing member, the area being a noimage area, is present in the electrification position, wherein the peripheral speed difference in the second period is smaller than the peripheral speed difference in the first period.

2. The image forming apparatus according to claim 1, wherein said electrification means includes an electrification member, which forms a nip portion in cooperation with said image bearing member and electrically conductive particles disposed in said nip portion.

3. The image forming apparatus according to claim 1, wherein said apparatus further comprises developing means, which develops the electrostatic image with a developer.

4. The image forming apparatus according to claim 2, wherein said apparatus further comprises developing means, which develops the electrostatic image with a developer.

5. An image forming apparatus according to claim 4, wherein said electrically conductive particles are supplied from said developing means to said electrification member by way of said image bearing member and said developing means is capable of recovering the developer from said image bearing member.

6. The image forming apparatus according to claim 2, wherein said electrification member includes a sponge layer in a surface thereof.

7. An image forming apparatus according to claim 1, wherein the peripheral speed difference is substantially zero in the second period.

8. The image forming apparatus according to claim 2, wherein said electrification member is driven and rotated by said image bearing member.

9. An image forming apparatus according to claim 1, wherein a voltage applied to said electrification means in the first period is substantially the same as a voltage applied to said image bearing member by said electrification means.

* * * * *

UNITED STATES PATENT AND TRADEMARK OFFICE

CERTIFICATE OF CORRECTION

PATENT NO. : 6,496,663 B2
DATED : December 17, 2002
INVENTOR(S) : Yasushi Shimizu et al.

It is certified that error appears in the above-identified patent and that said Letters Patent is hereby corrected as shown below:

Column 1,
Line 10, “relates” should read -- relates to --;
Line 11, “electrographic” should read -- electrophotographic --; and
Line 24, “is” should be deleted.

Column 3,
Line 46, “contrived” should read -- contrived as --.

Column 5,
Lines 43 and 63, “a” should read -- an --.

Column 7,
Line 57, “a” should read -- an --.

Column 8,
Line 43, “some” should read -- a --; and
Line 65, “82 m” should read -- $\mu$m --.

Column 9,
Line 1, “a” should read -- an --;
Line 41, “rubs” should read -- rub --; and
Line 43, “ozoneless” should read -- ozone-less --.

Column 12,
Line 27, “roller The” should read -- roller. ¶The --.

Column 15,
Line 12, “rest” should be deleted; and
Line 14, “and” should be deleted.

Column 16,
Line 35, “both the” should read -- both --.

Column 17,
Line 43, “be” (second occurrence) should be deleted.

Column 18,
Line 1, “is” should read -- it --;
Line 8, “an” should read -- a --; and
Line 11, “<Others>” should read -- <Other Embodiments> --.

UNITED STATES PATENT AND TRADEMARK OFFICE

CERTIFICATE OF CORRECTION

PATENT NO. : 6,496,663 B2
DATED : December 17, 2002
INVENTOR(S) : Yasushi Shimizu et al.

It is certified that error appears in the above-identified patent and that said Letters Patent is hereby corrected as shown below:

Column 20,
Line 11, “noimage” should read -- nonimage --; and “position,” should read -- position; and --.

Signed and Sealed this

Nineteenth Day of August, 2003

JAMES E. ROGAN
*Director of the United States Patent and Trademark Office*